US009211231B2

(12) United States Patent
Mansour et al.

(10) Patent No.: US 9,211,231 B2
(45) Date of Patent: Dec. 15, 2015

(54) VIAL ADAPTER FOR SIDE ENGAGEMENT OF VIAL CAP

(71) Applicants: George Michel Mansour, Pomona, CA (US); Tyler Devin Panian, Long Beach, CA (US)

(72) Inventors: George Michel Mansour, Pomona, CA (US); Tyler Devin Panian, Long Beach, CA (US)

(73) Assignee: Carefusion 303, Inc., San Diego, CA (US)

( * ) Notice: Subject to any disclaimer, the term of this patent is extended or adjusted under 35 U.S.C. 154(b) by 279 days.

(21) Appl. No.: 13/829,268

(22) Filed: Mar. 14, 2013

(65) Prior Publication Data

US 2014/0261727 A1 Sep. 18, 2014

(51) Int. Cl.

| | |
|---|---|
| ***A61J 1/00*** | (2006.01) |
| ***A61J 1/20*** | (2006.01) |
| *A61J 1/06* | (2006.01) |
| *A61J 1/14* | (2006.01) |

(52) U.S. Cl.

CPC *A61J 1/20* (2013.01); *A61J 1/1475* (2013.01); *A61J 1/065* (2013.01); *A61J 1/1406* (2013.01); *A61J 1/1418* (2015.05); *A61J 1/1481* (2015.05); *A61J 1/201* (2015.05); *A61J 1/2051* (2015.05); *A61J 1/2055* (2015.05); *A61J 1/2065* (2015.05); *A61J 1/2072* (2015.05); *Y10T 137/0402* (2015.04); *Y10T 137/598* (2015.04)

(58) Field of Classification Search

CPC ..... A61J 1/20; A61J 1/2089; A61J 1/2096; A61J 2001/2003–2001/2017; A61J 2001/2048; A61J 2001/2051; A61J 2001/2065

See application file for complete search history.

(56) References Cited

U.S. PATENT DOCUMENTS

| | | | | |
|---|---|---|---|---|
| 4,969,565 | A | 11/1990 | Justal et al. | |
| 2004/0199139 | A1 | 10/2004 | Fowles et al. | |
| 2010/0168712 | A1* | 7/2010 | Tuckwell et al. | 604/406 |
| 2011/0144614 | A1* | 6/2011 | Hereford | 604/414 |

FOREIGN PATENT DOCUMENTS

| | | | |
|---|---|---|---|
| EP | 1323403 | A1 | 7/2003 |
| WO | WO-2007101798 | A2 | 9/2007 |
| WO | WO-2009060419 | A2 | 5/2009 |

OTHER PUBLICATIONS

International Search Report and Written Opinion for International Application No. PCT/US2014/019632, dated Jul. 3, 2014, 11 pages.
International Preliminary Examining Authority Written Opinion for International Application No. PCT/US2014/019632, dated Mar. 31, 2015, 6 pages.

* cited by examiner

*Primary Examiner* — Philip R Wiest
*Assistant Examiner* — Benjamin Klein
(74) *Attorney, Agent, or Firm* — McDermott Will & Emery LLP

(57) ABSTRACT

A vial adapter for side engagement of a vial cap includes a needleless connector having a housing and defining one or more fluid pathways therein; an elongated piercing spike operatively coupled to the needleless connector, the elongated piercing spike having a longitudinal axis and one or more channels for fluid connectivity with the one or more fluid pathways; at least one housing arm coupled to the housing and extending parallel to the longitudinal axis; and a coupling member configured to orthogonally receive a vial cap with respect to the longitudinal axis, the coupling member having a planar surface, an aperture of the planar surface longitudinally aligned with the elongated piercing spike, and at least one support arm extending from the planar surface operatively coupled with the at least one housing arm to allow relative longitudinal movement between the coupling member and the elongated piercing spike.

20 Claims, 5 Drawing Sheets

VIAL ADAPTER FOR SIDE ENGAGEMENT OF VIAL CAP

CROSS-REFERENCES TO RELATED APPLICATIONS

Not applicable.

BACKGROUND

1. Field

The present disclosure generally relates to vials, and, in particular, to vial adapters.

2. Description of the Related Art

Medications and similarly dispensed substances are typically stored in a vial that is sealed with a vial cap having an access port for injecting fluid into the vial (e.g., adding a diluent for reconstitution of the medication therein) or removing fluid from the vial. A closure of the vial usually includes a pierceable rubber stopper formed of an elastomeric material such as butyl rubber or the like. The vial cap, typically formed of metal, is crimped over the pierceable rubber stopper and a flange of the vial to hold the stopper in place in the opening of the vial. The vial cap has an opening, or access port, through which the stopper and the vial opening may be accessed. A sharp cannula, such as a needle, is inserted into the access port of the vial cap piercing the rubber stopper to position the piercing end of the sharp cannula past the rubber stopper within the interior area of the vial. The piercing end of the sharp cannula includes an opening to make fluid connection with the contents of the vial.

In some arrangements, a vial adapter can include a needleless connection device whereby a piercing end is inserted into the access port of a vial cap to make fluid connection with the contents of a vial. Due, at least in part, to concern regarding the possibility of the transmission of blood-borne diseases through accidental needle punctures of patients and health care personnel, needleless connection devices are used with increasing frequency to reduce the risk of inadvertent punctures. Vial adapters incorporating needleless connection devices for fluid connection with vials typically have piercing ends less sharp than sharp cannulae. The piercing end of such vial adapters are generally larger than that of a sharp cannula, and have one or more openings to make fluid connection with the contents of the vial.

SUMMARY

In certain embodiments, a vial adapter is disclosed that comprises a needleless connector having a housing and defining one or more fluid pathways therein; an elongated piercing spike operatively coupled to the needleless connector, the elongated piercing spike having a longitudinal axis and one or more channels for fluid connectivity with the one or more fluid pathways; at least one housing arm coupled to the housing and extending parallel to the longitudinal axis; and a coupling member configured to orthogonally receive a vial cap with respect to the longitudinal axis, the coupling member having a planar surface, an aperture of the planar surface longitudinally aligned with the elongated piercing spike, and at least one support arm extending from the planar surface operatively coupled with the at least one housing arm to allow relative longitudinal movement between the coupling member and the elongated piercing spike.

In certain embodiments, an apparatus for adapting a vial is disclosed that comprises receiving tracks configured to orthogonally receive a vial cap into an opening between the receiving tracks; a housing having a fluid pathway connected to a piercing element that extends along a longitudinal axis; and a longitudinal movement arrangement coupled between the housing and the receiving tracks to allow controllable movement of the housing and the piercing element along the longitudinal axis with respect to the receiving tracks.

In certain embodiments, an apparatus for coupling a connector having a piercing element to a vial is disclosed that comprises receiving tracks configured to orthogonally receive a vial cap into an opening between the receiving tracks; a housing configured to receive the connector; and a longitudinal movement arrangement coupled between the housing and the receiving tracks to allow controllable movement of the housing along a longitudinal axis with respect to the receiving tracks.

In certain embodiments, a method for establishing fluid connectivity with a vial is disclosed that comprises orthogonally receiving a vial cap of the vial into an opening between receiving tracks such that a piercing element of a connector is disposed above the vial cap; longitudinally moving the connector to insert the piercing element through the vial cap.

It is understood that various configurations of the subject technology will become readily apparent to those skilled in the art from the disclosure, wherein various configurations of the subject technology are shown and described by way of illustration. As will be realized, the subject technology is capable of other and different configurations and its several details are capable of modification in various other respects, all without departing from the scope of the subject technology. Accordingly, the summary, drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1A:
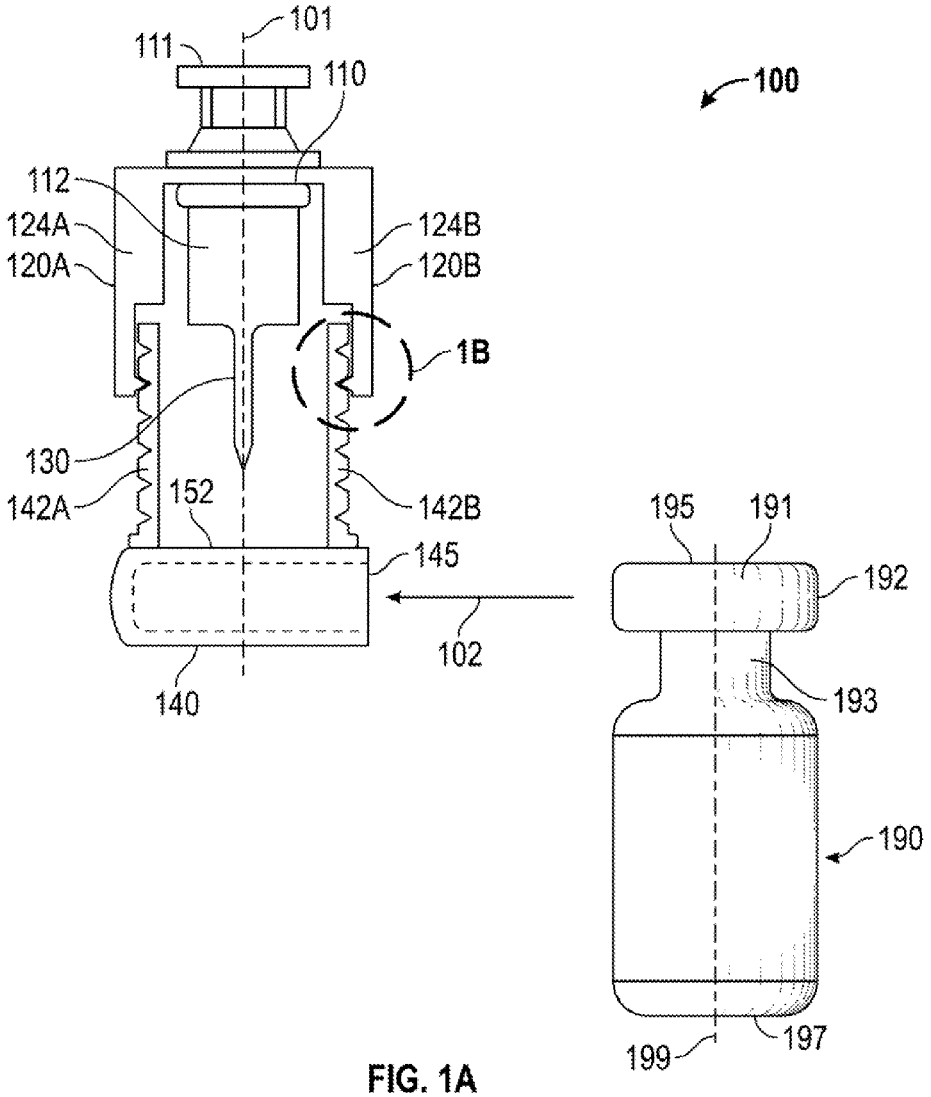
FIG. 1A is front plan view illustrating an example of a vial adapter, in accordance with various aspects of the present disclosure.

The detailed description set forth below is intended as a description of various configurations of the subject technology and is not intended to represent the only configurations in which the subject technology may be practiced. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element or sub-element numbers for ease of understanding. Reference numbers may have letter suffixes appended to indicate separate instances of a common element while being referred to generically by the same number without a suffix letter.

While the following description is directed to the administration of medical fluid to a patient by a medical practitioner using the disclosed vial adapters, it is to be understood that this description is only an example of usage and does not limit the scope of the claims. Various aspects of the disclosed vial adapters may be used in any application where it is desirable to secure a container, as well as guide and precisely position a piercing member within the container.

The disclosed vial adapter overcomes several challenges discovered with respect to certain conventional vial adapters. One challenge with certain vial adapters is achieving the proper balance of force and leverage required to couple a vial adapter to a vial. For example, with smaller vials, there may be little surface area on the vial bottom with which to properly balance the vial such that a spike can be inserted into its small access port without slipping and causing damage to the vial or injury to the medical practitioner. Moreover, a deep rubber stopper may be used, for instance, when the medication therein is hazardous and/or particularly susceptible to contamination with air. While a sharp, generally thin needle will easily puncture such a deep rubber stopper in a small vial, a spike or piercing end of a needleless connection device may be challenged to do so. Another challenge with certain vial adapters is that they provide very imprecise means to position a spike within the interior of the vial past the rubber stopper. When the contents of the vial are extremely expensive, for example, chemotherapy medications, the precise positioning of the spike is important to retrieving all of the vial's valuable contents. In some instances, once a spike extends a distance into the vial, it cannot be retracted either for safety precautions or otherwise.

Therefore, in accordance with the present disclosure, it is advantageous to provide a vial adapter as described herein that first secures the vial, then is configured to guide the spike to effectively pierce the rubber stopper of the vial. Additionally, it is advantageous to provide a vial adapter as described herein that provides for controlled, minute increments of the spike into the vial such that a fluid channel aperture may be precisely placed in the interior of a vial to maximize the amount of medication that is extracted therefrom.

FIG. 1A. shows a vial adapter 100 comprising a needleless connector 110, an elongated piercing spike 130, and a coupling member 140, in accordance with certain embodiments. The needleless connector 110 has a port 111 and a housing 112 for enclosing the various components therein utilized for providing a needleless connection. It is understood that embodiments of the vial adapter 100 are not limited by the type of needleless connection technology utilized. Thus, various types of needleless connectors 110 for controlling fluid flow can be used.

The elongated piercing spike 130 is operatively coupled to the needleless connector 110 and has a longitudinal axis 101. In accordance with certain embodiments, the elongated piercing spike 130 may be fixably connected to or fabricated integral with the needleless connector 110. In operation, the elongated piercing spike 130 and needleless connector 110 will longitudinally move along the longitudinal axis 101. However, it is understood that the needleless connector 110 need not be aligned with the elongated piercing spike 130. For example, in some embodiments, the needleless connector 110, or a portion thereof, may be angled in a manner to promote ease of access to the port 111 of the needleless connector 110 for use in certain staging or vial arrangements.

Housing arms 120*a*, 120*b* are coupled to the housing 112 of the needleless connector 110 in any suitable fashion and extend parallel to the longitudinal axis 101 for engagement with the coupling member 140. The coupling member 140 has a planar surface 152 and support arms 142*a*, 142*b* extending from the planar surface. The support arms 142*a*, 142*b* are operatively coupled with corresponding housing arms 120*a*, 120*b* to promote longitudinal movement between the coupling member 140 and the elongated piercing spike 130. Housing arms 120*a*, 120*b* include tubular portions 124*a*, 124*b* for receiving the support arms 142*a*, 142*b* of the coupling member 140. In this regard, a more rigid and sturdy interconnection between the coupling member 140 and needleless connector 110 and elongated piercing spike 130 results.

Figure 1B:
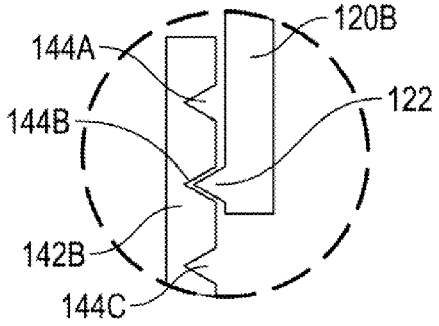
FIG. 1B is an enlarged view of a portion of FIG. 1A illustrating an example of engaging arms of a vial adapter, in accordance with various aspects of the present disclosure.

Referring to FIG. 1B, an enlarged cross-sectional view of housing arm 120*b* and support arm 142*b* shows the manner of engagement therebetween in accordance with certain embodiments. Housing arm 120*b* includes one or more detents 122 and support arm 120*b* includes a plurality of notches 144*a*, 144*b*, 144*c*. The one or more detents 122 engage with the plurality of notches 144 to provide fixable or lockable longitudinal movement along the longitudinal axis 101. The one or more detents 122 can be made to disengage with or release from notch 144*b* by applying a downward force to the housing arms 120*a*, 120*b* and/or the needleless connector 110, for example. Moreover, the plurality of notches 144 (and corresponding one or more detents 122 if more than one detent 122 is utilized) may be spaced at defined increments to promote a controlled fixable longitudinal movement. In some embodiments, the distance between adjacent notches 144 may be equal. However, in other embodiments, the distance between adjacent notches 144 may be larger at an expected position when the elongated piercing spike 130 pierces the vial 190, whereas the distance between adjacent notches 144 may be smaller at an expected position when the elongated piercing spike 130 has already pierced the vial 190.

In this regard, the elongated piercing spike 130 is fixably or selectively lockably movable along the longitudinal axis 101 such that small incremental longitudinal movements can be made to guide the elongated piercing spike 130 and precisely obtain a desired depth of it into the vial 190, and, therefore, avoid forcing the elongated piercing spike 130 past such a desired depth.

It is to be appreciated that other means are contemplated and may be employed to facilitate longitudinal interconnection, and fixable longitudinal movement between the coupling member 140 and elongated piercing spike 130. For example, the housing arms 120*a*, 120*b* may be replaced by a cylinder with internal projections that interact with notches 144.

In other embodiments, a cylinder can be provided with internal threads and interact with threads that replace the notches 144.

An example of a vial 190 is also show in FIG. 1A. The vial may be a standard-sized vial 190 containing medications and similarly dispensed substances therein. The vial 190 has a vial cap 191 that includes an access port 195 on a top surface and a circumferential edge 192, a vial neck 193, and a flat vial bottom 195 for stabilization when inserting a medical implement, such as a sharp cannula or spike into the interior of the vial 190.

The coupling member 140 includes a side opening and is configured in a manner such that it may orthogonally receive 102 the vial cap 191 of the vial 190 with respect to the longitudinal axis 101 of the elongated piercing spike 130. In operation, a vial center longitudinal axis 199 is aligned with the longitudinal axis 101 of the elongated piercing spike 130 such that the elongated piercing spike 130 will pierce the rubber stopper or like membrane of the access port 195 similarly aligned proximal to the vial center longitudinal axis 199.

Figure 2:
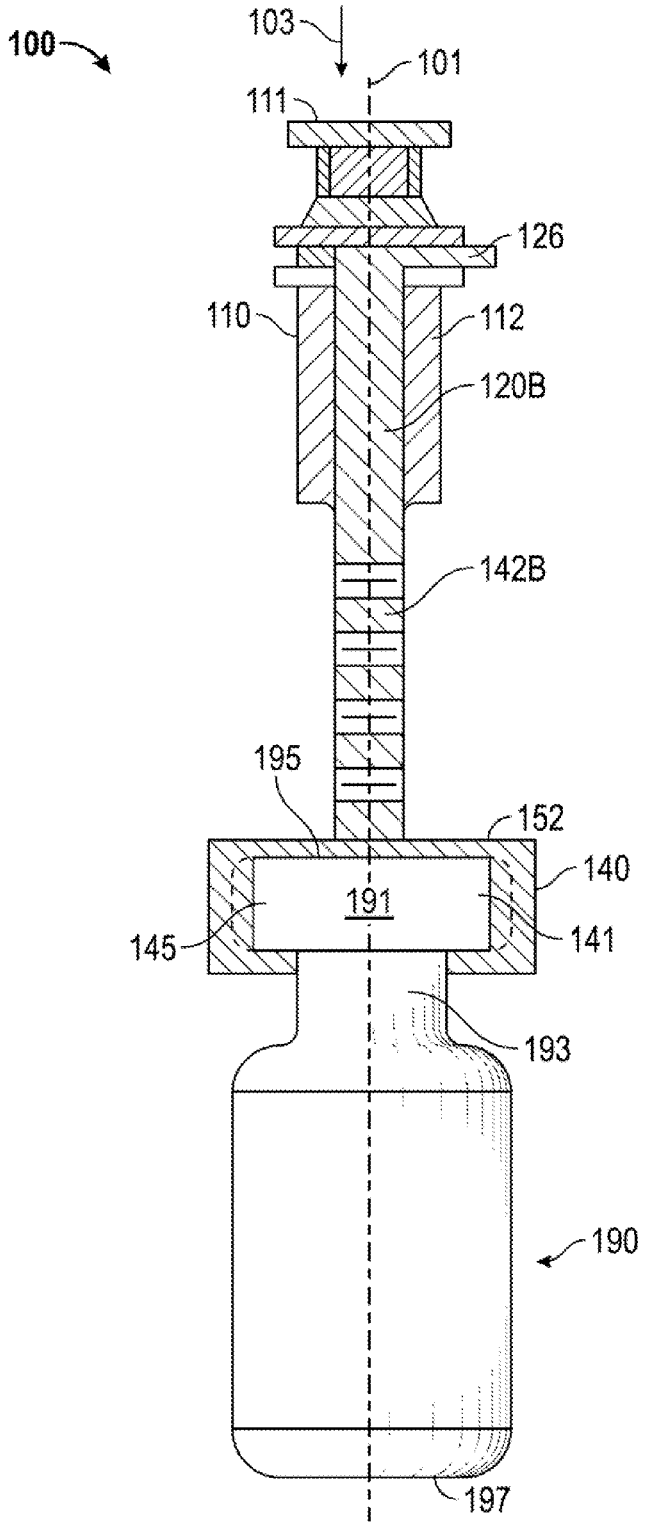
FIG. 2 is a side plan view illustrating an example of a vial adapter coupled to a vial, in accordance with various aspects of the present disclosure.

FIG. 2 depicts the vial adapter 100 coupled to the vial 190 from a side view (i.e., FIG. 1A rotated 90 degrees clockwise along the longitudinal axis 101 and looking into the side opening 145 with the vial cap 191 therein). In certain embodiments, the housing arms 120*a*, 120*b* include bridge portion 126 that connects housing arms 120*a*, 120*b* to the housing 112. In some embodiments, the bridge portion 126 is permanently affixed to or integral with the housing 112. However, in other embodiments, the bridge portion 126 may be securely, but removably attached to the housing 112 of the needleless connector 110 so that the housing arms 120*a*, 120*b* and bridge portion 126, as well as the coupling member 140 can be reused with another needleless connector 110 and vial 190.

Although housing arms 120*a*, 120*b* and corresponding or mating support arms 142*a*, 142*b* for guiding the elongated piercing spike 130 are shown in the embodiments of FIGS. 1A, 1B, and 2, it is to be appreciated that a single housing arm 120 may be used in some embodiments, and more than two housing arms 120 may be used in other embodiments.

In operation, an axial force 103 is applied (generally downward with the vial bottom 197 on a flat surface) to the housing arms 120*a*, 120*b* and/or the needleless connector 110 such that the elongated piercing spike 130 (behind housing arm 120*b* and support arm 142*b* in the view of FIG. 2) pierces the access port 195 of the vial cap 191 and extends into the vial 190.

Figure 3A:
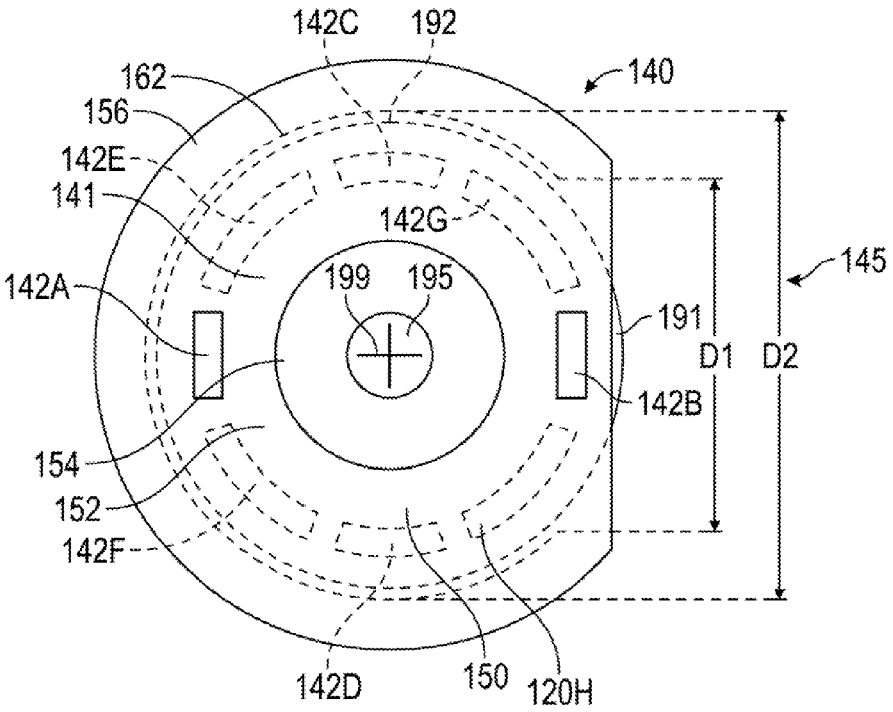
FIG. 3A is a top plan view illustrating an example of a coupling member of a vial adapter, in accordance with various aspects of the present disclosure.
Figure 3B:
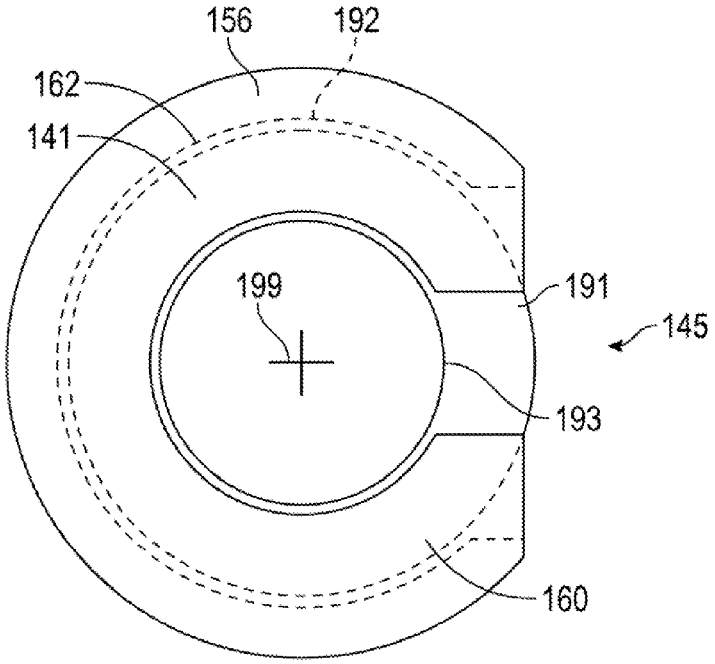
FIG. 3B is a bottom plan view illustrating an example of a coupling member of a vial adapter, in accordance with various aspects of the present disclosure.

With reference to FIGS. 3A and 3B, a top plan view (FIG. 3A) and a bottom plan view (FIG. 3B) of coupling member 140 according to certain embodiments is shown. The coupling member 140 comprises a first receiving channel 141, which includes a side opening 145 for receiving the vial cap 190 of a vial (shown already received in the first receiving channel 141). The first receiving channel 141 further includes a top portion 150 defined by a planar surface 152 and an aperture 154 of the planar surface 152, a bottom portion 160, and an arcuate side wall 156 connecting the top portion 150 and the bottom portion 160. The bottom portion 160 is configured to extend proximal to the vial neck 193. The rim 192 or edge around the vial cap 191 is shown with respect to an inner surface 162 of the arcuate side wall 156. The aperture 154 of the planar surface 152 is longitudinally aligned with the elongated piercing spike 130 (not shown), and sized to receive the access port 195 disposed on the vial cap 191.

In some embodiments, the inner surface 162 may include a rubber film or similar gripping layer to aid in securing the vial cap 191 within the first receiving channel 141.

In some embodiments, the first receiving channel 141 is configured to receive and secure a predetermined vial cap size. For example, predetermined vial cap sizes for which the first receiving channel 141 may be configured to receive include 13 mm, 20 mm, 28 mm, and 32 mm standard-sized vial caps and corresponding vials. Moreover, in certain embodiments, a cross sectional length (D1) of the arcuate side wall defining the side opening 145 is less than the diameter (D2) of the predetermined vial cap size. In this regard, the vial cap 191 will snap into the first receiving channel 141 and be secured therein.

An orientation of the support arms 142 in accordance with some embodiments is shown in top plan view of FIG. 3A. Support arms 142*a*, 142*b* longitudinally extend from the planar surface 152 and are aligned with the side opening 145 in certain embodiments to minimize or avoid displacement when the vial cap 191 enters or is removed from the first receiving channel 141. Alternatively, or in addition to, support arms 142*c*, 142*d* may similarly extend from the planar surface 152. For example, support arms 142*c*, 142*d*, in conjunction with corresponding housing arms 120 (not shown) may provide additional support and structure for a needleless connector such as embodiments utilizing a plurality of different-sided receiving channels (to be described latter with respect to FIG. 5) that require longer elongated piercing spikes 130 to traverse the receiving channels. In some embodiments, the housing arms 120 may be replaced by one or more annular arms 120*e*, 120*f*, 120*g*, 120*h* to form a partial or complete cylinder having internal projections that interact with notches 144.

Figure 4:
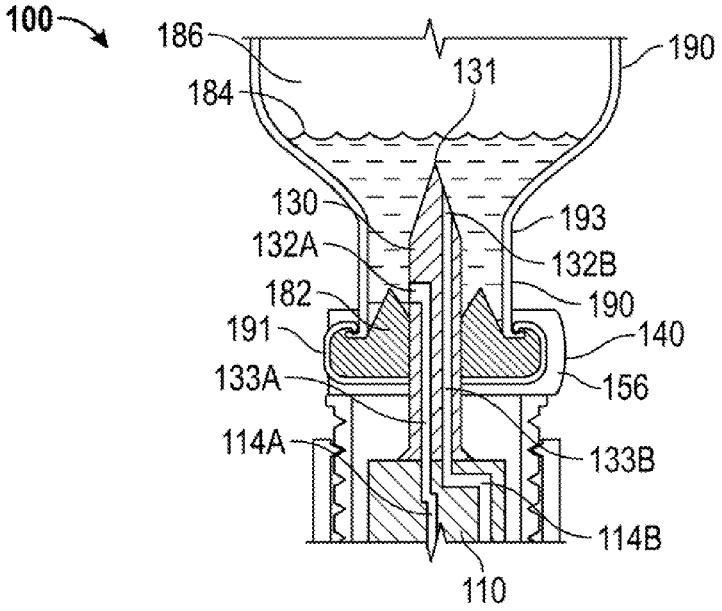
FIG. 4 is a partial longitudinal cross-sectional view illustrating an example of a coupling member of a vial adapter, in accordance with various aspects of the present disclosure.

FIG. 4 shows a partial longitudinal cross-sectional view of the vial adapter 100 in which the coupling member 140 is attached to the vial cap 191 and the elongated piercing spike 130 is inserted through the access port 145 and the rubber stopper 182 of the vial 190. As shown, the vial 190 and vial adapter 100 are inverted from an upright position that would be used to first pierce the vial 190 (see FIG. 2). Thus, medication 184 may be drawn from the vial 190 and air 186 may be added to the vial 190 to maintain a neutral or equalized pressure within the vial 190.

In certain embodiments, one or more channels 133*a*, 133*b* of the elongated piercing spike 130 establish fluid connectivity with one or more fluid pathways 114*a*, 114*b* of the needleless connector 110. For example, medication 184 may flow through medication fluid channel 133*a* and medication fluid pathway 114*a* to the port 111 (not shown) or proximal to the port from a medical implement, whereas air 186 may flow from the port 111 (not shown) or proximal to the port from the medical implement (or a different port in some embodiments) through the air pathway 114*b* and air channel 133*b* into the vial 190. Moreover, in some implementations, an air aperture 132*b* of the air channel 133*b* is disposed on the elongated piercing spike 130 proximal to a pointed end 131 and a fluid aperture 132*a* of the medication fluid channel 133*a* is disposed distal to the pointed end 131.

Therefore, by precisely positioning the fluid aperture 132*a* adjacent to an interior facing side of the rubber stopper 182 with the vial adapter 100, substantially all of the medication 184 can be extracted from the vial 194. Such complete extraction is especially beneficial when the medication 184 is chemotherapy medication or other similarly expensive and/or hazardous medications.

Figure 5:
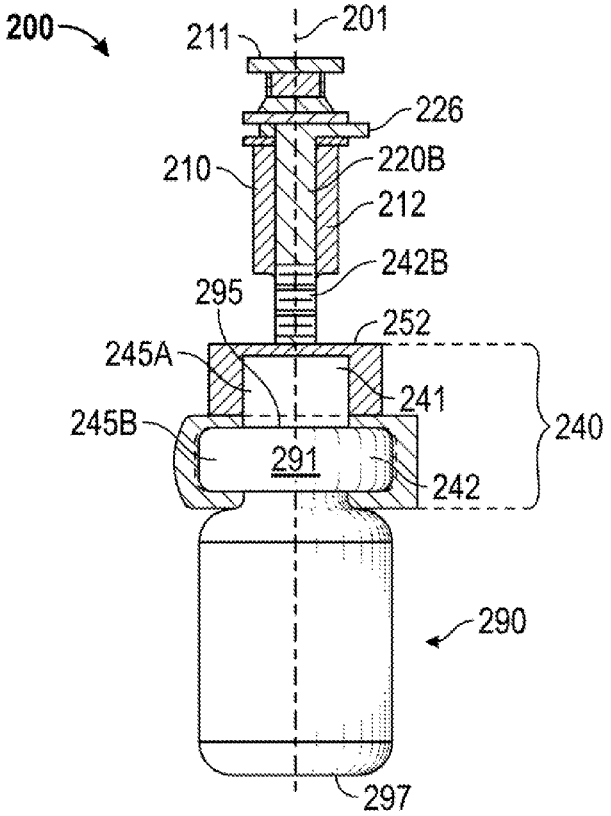
FIG. 5 is a side plan view illustrating an example of a vial adapter coupled to a vial, in accordance with various aspects of the present disclosure.

Referring to FIG. 5 another example of a vial adapter 200 is shown. Vial adapter 200 includes many similar elements and features (identified by like reference numbers) as the vial adapter 100 described above. However, the coupling member 240 of vial adapter 200 comprises a first receiving channel 241 having a side opening 245A and a second receiving channel 241 having a side opening 245B. In certain embodiments, the vial adapter 200 is arranged in a staggered configuration such that a number of receiving channels configured to receive predetermined vial cap sizes are concentrically oriented.

In the staggered configuration, a smallest of the predetermined vial cap sizes of the first receiving channel (i.e., the receiving channel having the planar surface 252 included as its top portion) is a smallest predetermined vial cap size of the receiving channels. A predetermined vial cap size of a last of the additional receiving channels is a largest predetermined vial cap size of the additional receiving channels. In such a staggered configuration, a top portion of an additional receiving channel will comprise the bottom portion (see, e.g., FIG. 3B) of the previous channel. Therefore, the coupling member 240 may comprise a total of three or five receiving channels in accordance with some embodiments. In such embodiments, the elongated piercing spike 230 (not shown) is configured to a length sufficient to extend through each successive receiving channel.

Accordingly, a single vial adapter 200 can be used for differently-sized vials, such as vial 290, without compromising rigidity of and secure fitting of each receiving channel (e.g., first receiving channel 241 and second receiving channel 242) in the coupling member 240.

Figure 6:
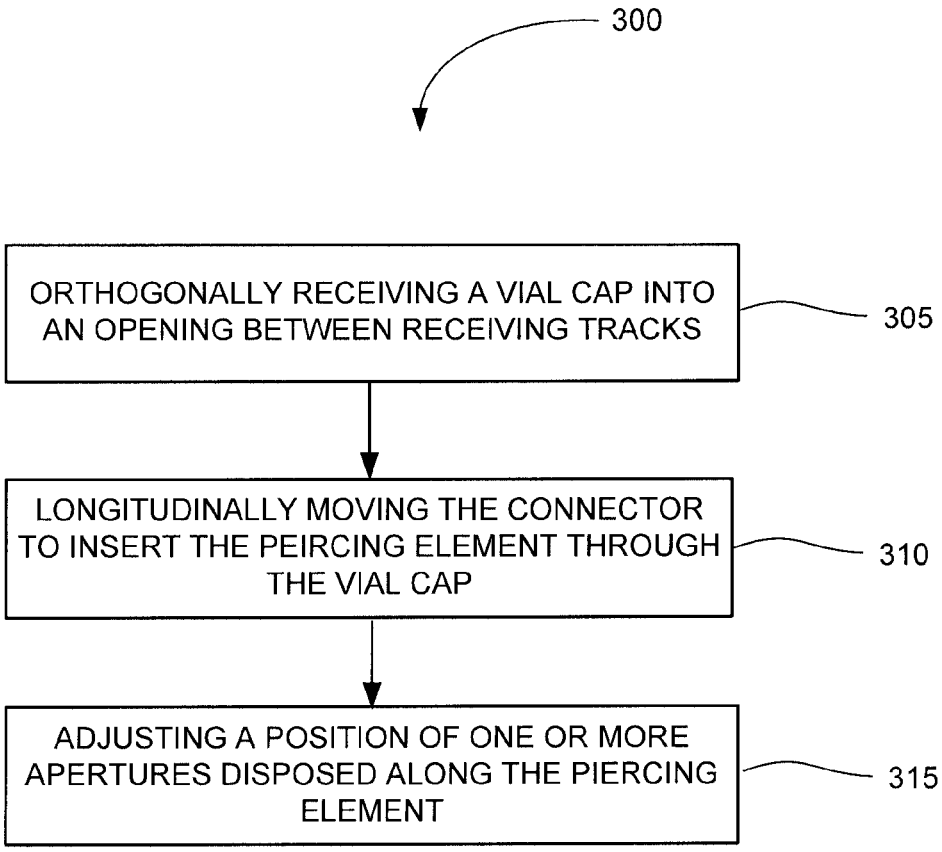
FIG. 6 is a flow chart illustrating an example of a method for establishing fluid connectivity with a vial, in accordance with various aspects of the present disclosure.

FIG. 6 is a flow chart of an exemplary method 300 for establishing fluid connectivity with a vial 190. In certain embodiments, a vial adapter such as exemplary vial adapters 100, 200 described herein, is utilized in method 300. In operation 305, a vial cap is orthogonally received in an opening between receiving tracks or similar coupling member. When the vial cap is orthogonally received, a piercing element of a connector is disposed above the vial cap and not engaged with the vial cap of the vial contents in any way. In this regard, the vial can be staged for fluid connectivity prior to establishing fluid communications with the medication in the vial.

In operation 310, the connector longitudinally moved to insert the piercing element through the vial cap. For example, a longitudinal movement arrangement is utilized to control longitudinal movement in which a user pushes down on the connector and/or portion of the longitudinal movement arrangement. Thus, the piercing element is inserted through the vial cap to pierce the septum of the vial cap. Next, in operation 315, a position of one or more apertures is adjusted within an interior of the vial. The one or more apertures are disposed along the piercing element at different locations in certain embodiments. For example, in certain embodiments, a first aperture establishes a fluid pathway for the medication in the vial and a second aperture establishes a gas pathway for maintaining proper pressurization of the interior of the vial while the vial is securely engaged with the receiving tracks or coupling member. This adjustment operation provides for fine tune adjustments of the position of the one or more apertures in accordance with some embodiments.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

In one aspect, the term "coupled" or the like may refer to being directly coupled. In another aspect, the term "coupled" or the like may refer to being indirectly coupled.

Terms such as "top," "bottom," "front," "rear" and the like if used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Various items may be arranged differently (e.g., arranged in a different order, or partitioned in a different way) all without departing from the scope of the subject technology. For example, in some embodiments, the one or more detents 122 may be placed on the support arm 142, and the plurality of notches 144 may be placed on the housing arm 120, and/or the tubular portion 124 may be included in the support arm 142 for receiving the housing arm 120 (see, e.g., FIGS. 1A and 1B).

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. §101, 102, or 103, nor should they be interpreted in such a way.

What is claimed is:

1. A vial adapter comprising:

a needleless connector having a housing and defining one or more fluid pathways therein; an elongated piercing spike operatively coupled to the needleless connector, the elongated piercing spike having a longitudinal axis and one or more channels for fluid connectivity with the one or more fluid pathways;

at least one housing arm coupled to the housing and extending parallel to the longitudinal axis; and a coupling member configured to orthogonally receive a vial cap with respect to the longitudinal axis, the coupling member having a planar surface, an aperture of the planar surface longitudinally aligned with the elongated piercing spike, and at least one support arm extending from the planar surface operatively coupled with the at least one housing arm to allow relative longitudinal movement between the coupling member and the elongated piercing spike, the coupling member comprising a plurality of receiving channels, each receiving channel configured to orthogonally receive and secure a predetermined vial cap size.

2. The vial adapter of claim 1, wherein the first receiving channel comprises a side opening for receiving the vial cap of a vial, a top portion defined by the planar surface and the aperture of the planar surface, a bottom portion, and an arcuate side wall connecting the top portion and the bottom portion.

3. The vial adapter of claim 2, wherein a cross sectional length of the arcuate side wall defining the side opening is less than the diameter of the predetermined vial cap size.

4. The vial adapter of claim 1, wherein the predetermined vial cap size is one of 13 mm, 20 mm, 28 mm, or 32 mm.

5. The vial adapter of claim 1, wherein the coupling member is arranged in a staggered configuration such that the predetermined vial cap size of the first receiving channel is a smallest predetermined vial cap size of the receiving channels and a predetermined vial cap size of a last of the one or more additional receiving channels is a largest predetermined vial cap size of the receiving channels.

6. The vial adapter of claim 5, wherein the receiving channels of the staggered configuration are concentrically oriented.

7. The vial adapter of claim 1, wherein the at least one support arm comprises two or more support arms and the at least one housing arm comprises two or more housing arm, and wherein each of the two or more support arms extending from the planar surface are operatively coupled with a corresponding one of the two or more support arms.

8. The vial adapter of claim 1, wherein the at least one support arm and the at least one housing arm are configured to promote longitudinal movement such that the coupling member is fixably moveable in a plurality of defined increments with respect to the elongated piercing spike.

9. The vial adapter of claim 8, wherein the at least one support arm comprises a plurality of notches and the least one housing arm comprises one or more detents for engaging with the plurality of notches.

10. The vial adapter of claim 1, wherein the at least one housing arm comprises a tubular portion for receiving the at least one support arm.

11. The vial adapter of claim 1, wherein the at least one housing arm is one of fixably attached to or integral with the housing of the needleless connector assembly.

12. The vial adapter of claim 1, wherein the at least one housing arm is removably attached to the housing of the needleless connector assembly.

13. The vial adapter of claim 1, wherein the one or more channels of the elongated piercing spike comprise a medication fluid channel and an air channel, and one or more fluid pathways of the needleless connector comprises a medication fluid pathway and an air pathway, and wherein the medication fluid channel and the air channel are fluidly connected to the medication fluid pathway and the air pathway, respectively.

14. The vial adapter of claim 13, wherein an air aperture of the air channel is disposed on the elongated piercing spike proximal to a pointed end of the piercing spike and a fluid aperture of the medication fluid channel is disposed distal to the pointed end.

15. An apparatus for adapting a vial, the apparatus comprising:

a plurality of receiving tracks configured to orthogonally receive a plurality of vial cap sizes into a plurality of openings between the receiving tracks, each opening configured to receive and secure a predetermined vial cap size;

a housing having a fluid pathway connected to a piercing element that extends along a longitudinal axis; and a longitudinal movement arrangement coupled between the housing and the receiving tracks to allow controllable movement of the housing and the piercing element along the longitudinal axis with respect to the receiving tracks the coupling member comprising a plurality of receiving channels, each receiving channel configured to orthogonally receive and secure a predetermined vial cap size.

16. The apparatus of claim 15, wherein the longitudinal movement arrangement comprises one of interconnected arms or interconnected cylinders.

17. An apparatus for coupling a connector having a piercing element to a vial, the apparatus comprising:

a plurality of receiving tracks configured to orthogonally receive a plurality of vial cap sizes into a plurality of openings between the receiving tracks, each opening configured to receive and secure a predetermined vial cap size;

a housing configured to receive the connector; and a longitudinal movement arrangement coupled between the housing and the receiving tracks to allow controllable movement of the housing along a longitudinal axis with respect to the receiving tracks.

18. A method for establishing fluid connectivity with a vial, the method comprising:

orthogonally receiving a vial cap of the vial into one of a plurality of openings between a plurality of receiving tracks such that a piercing element of a connector is disposed above the vial cap, wherein each opening is configured to orthogonally receive and secure a predetermined vial cap size;

longitudinally moving the connector to insert the piercing element through the vial cap.

19. The method of claim 18, further comprising:

adjusting a position of one or more apertures disposed along the piercing element within an interior of the vial.

20. The vial adapter of claim 6, wherein the top portion of one receiving channel comprises the bottom portion of another receiving channel.

* * * * *